US008698682B1

(12) United States Patent
Desclos et al.

(10) Patent No.: US 8,698,682 B1
(45) Date of Patent: Apr. 15, 2014

(54) MEDIA ANTENNA FOR COMMUNICATION SYSTEMS

(75) Inventors: Laurent Desclos, San Diego, CA (US); Jeffrey Shamblin, San Marcos, CA (US)

(73) Assignee: Ethertronics, Inc., San Diego, CA (US)

( * ) Notice: Subject to any disclaimer, the term of this patent is extended or adjusted under 35 U.S.C. 154(b) by 200 days.

(21) Appl. No.: 13/151,268

(22) Filed: Jun. 1, 2011

Related U.S. Application Data

(60) Provisional application No. 61/350,255, filed on Jun. 1, 2010.

(51) Int. Cl.
*H01Q 9/00* (2006.01)

(52) U.S. Cl.
USPC ..... 343/745; 455/572

(58) Field of Classification Search
USPC ..... 343/745; 455/572, 127.1
See application file for complete search history.

(56) References Cited

U.S. PATENT DOCUMENTS

2006/0058072 A1* 3/2006 Buren et al. ..... 455/572

* cited by examiner

*Primary Examiner* — Karl D Frech
(74) *Attorney, Agent, or Firm* — Coastal Patent Law Group, P.C.; Joshua S. Schoonover, Esq.

(57) ABSTRACT

An antenna accessory is provided for external connection with a wireless communications device. The antenna accessory includes a media antenna adapted for FM and DVB-H reception. In this regard, the media antenna can be supplied exterior to the wireless device components for improved isolation and antenna performance.

10 Claims, 5 Drawing Sheets

MEDIA ANTENNA FOR COMMUNICATION SYSTEMS

FIELD OF THE INVENTION

The present invention relates to antennas for use in portable electronic devices, and more particularly to an external antenna accessory adapted for removable attachment with a mobile device or communication system.

BACKGROUND OF THE INVENTION

A multitude of portable devices including cellular phones, personal media devices, and laptops are widely used and commercially available. These devices continue to become more popular as demand for improved devices continues to grow. As market trends move towards smaller devices in an effort to enhance portability, device components are collaterally constrained to meet market requirements. At the same time, consumers are demanding a multitude of applications for use with portable consumer electronics, such as internet, radio, television, communications, and others. As trends in consumer demands move towards multi-application portable electronic devices, component manufacturers are required to meet new requirements, and therefore develop novel solutions to satisfy consumer demands.

Because portability is an ongoing necessity in the portable electronics market, size constraints must remain a primary focus of component manufactures. Cell phones, for example, are becoming smaller in size and lighter in weight while providing an increased number of useable features, such as internet, radio, television, communications, and others. To meet the demand for multi-application cell phones, additional and/or larger antennas and other components are required. Cell phone and other portable electronic device manufacturers are moving toward reducing size of components and unnecessary bulk space, and reusing space.

Antennas, specifically, have been a major focus of reducing size and space in electronic portable devices. Recently, FM radio and DVB-H TV reception have become requirements in a large number of mobile phones and similar wireless communications devices. Antenna performance is a key parameter for quality reception. Mobile handsets are very small compared to wavelengths at FM, DVB-H, VHF-III, and UHF-IV/V frequencies. Consequently, the antennas used for these applications on handsets will be electrically small. These electrically small antennas will tend to be narrow band and require low loss matching techniques to preserve efficiency. One major problem is that multiple electrically small antennas being embedded in a small wireless device will tend to couple, thereby degrading performance. The reduced volume allowed for an internal antenna coupled with the strict requirement that the internal FM and DVB-H. VHF and UHF TV antennas must not interfere with the main communications antenna or other ancillary antennas in the handset makes the task of integrating these antennas into mobile devices quite difficult.

Current market-available antenna designs and prior art antennas are not suitable for overcoming the aforementioned problems. Taking into consideration the requirements for the next generation of devices along with the deficits of current technologies, a solution is needed which achieves efficiency from an antenna required to cover the large FM frequency band. Antennas commonly known and available which generally cover the whole frequency range tend to display inadequate antenna radiation efficiency at a fixed volume.

There is an immediate need for an improved antenna which will provide efficient operation over FM, DVB-H, VHF, and UHF TV frequencies while minimizing the volume required in the device. There is a need for such an antenna that will further not interfere with other antennas or wireless components in the portable device. Furthermore, there is a need to simplify the method for integrating the low frequency antenna with the mobile device to reduce design time and time to market.

SUMMARY OF THE INVENTION

Accordingly, it is an object of the present invention to solve these and other problems in the art by providing an improved antenna for enhanced performance of a related device by operating at FM, DVB-H, VHF, and UHF TV frequencies, generally frequencies less than 900 MHz, and often less than 700 MHz, without adding bulk space to the associated device. It is another objective to provide an active tunable antenna integrated into a module that can be attached or coupled to a wireless device, after the wireless device is designed and manufactured. It is another goal of the various embodiments of the present invention to provide an enhanced antenna system which successfully enables efficient operation over FM and VHF and UHF TV frequencies while providing an antenna solution that does not require any volume within the portable wireless device. The antenna system must further operate without interference with the main antenna or other wireless components of the portable wireless device.

In keeping with these objectives and with others which will become apparent hereinafter, an antenna accessory is provided, the antenna accessory is adapted for removable engagement with a wireless communications device, such as a mobile phone or laptop computer. The antenna accessory may further include one or more active components for actively tuning the antenna. The one or more active components and the antenna may further be located within a housing or body portion, such as a device case or a module accessory.

In a general embodiment, an antenna accessory includes an antenna element, a matching circuit, a connector, and a body portion. The connector provides a means to connect the antenna to the internal radios and/or receivers of the wireless device, and may further provide a means of mechanical attachment to the wireless device.

The assembly may further include a circuit board that contains one or more passive or active components to impedance match and dynamically tune an antenna.

The antenna element can be a planar conductor, a wire or a coil. The antenna element can also be etched on the circuit board. The antenna element can also be printed or electroplated on the body portion.

In another embodiment, an active tunable antenna having an antenna element and an active tuning circuit is integrated into the body portion, with the body portion attached to the wireless device using a connector. The connector will provide a positive contact terminal and negative contact terminal for supplying power to the portable electronic device, a feed contact terminal for driving the antenna, and a ground contact terminal for connecting the antenna to ground.

In another embodiment, the assembly includes multiple layers on the outer or inner surface of the body portion. Each layer can include one or more portions of an antenna, thereby providing a multi-layer antenna assembly. For example, an antenna element can be attached to the outer layer while feed lines and distributed matching elements, such as transmission line elements, can be attached to inner layers. The multiple conductive layers used to form the antenna element and feed lines can be separated by non-conductive layers. The non-conductive layers can be formed from polymer, fiber, paper, or ferrite materials.

In another embodiment, an antenna element and connector are embedded into a plastic or rubber cell phone cover or device case. The plastic or rubber device case is typically used to protect the cell phone from damage and the elements.

In another embodiment, one or more parasitic elements can be incorporated into the antenna module. Parasitic elements can be used for Hearing Aid Compatibility (HAC) reduction. Parasitic elements can also be used for Specific Absorption Rate (SAR) reduction.

Other aspects and features of the present invention will become apparent to those having ordinary skill in the art upon review of the following description of specific embodiments of the invention in conjunction with the accompanying figures. It is to be understood that both the foregoing general description and the following detailed description are provided for illustrative purposes and are not intended to limit the scope of the claimed invention.

BRIEF DESCRIPTION OF THE DRAWINGS

These and other features can be further understood upon a thorough review of the descriptions, and particularly when viewed in conjunction with the appended drawings, wherein.

DETAILED DESCRIPTION OF THE PREFERRED EMBODIMENTS

Figure 1A:
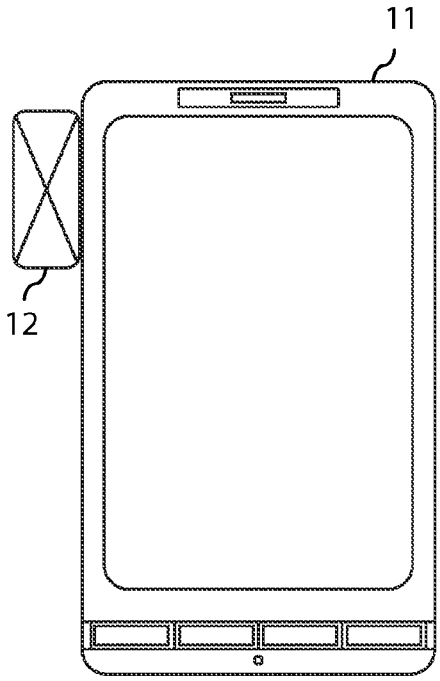
FIGS. 1(*a-b*) illustrate examples of an antenna accessory attached to a wireless device.

An antenna accessory for media applications such as FM radio, television, and the like is provided for use with portable electronic devices such as cell phones, laptops, and media players. For example, the antenna can be designed to function over DVB-H frequencies, such as FM (87.5 MHz-108 MHz), VHF-III (170 MHz-230 MHz), and UHF-IV/V (470 MHz-862 MHz). The antenna accessory includes an antenna radiating element, at least one connector element, and device cover or case. The antenna accessory is designed for removable engagement with a wireless communications device. The connector element of the antenna accessory is generally designed to with the external headphone connector of cell phones, laptops, and wireless devices and provides a method to connect the antenna of the antenna accessory to the receivers and radios internal to the host device. However, the connector element can be adapted for other connections with a wireless communications device. The connector element further provides a means to bring power from the wireless communications device to supply active circuits contained in the antenna accessory.

Although an antenna accessory can be designed to operate at any frequency, additional benefits are presented for low frequency antenna applications. Below 900 MHz, and more particularly, below 700 MHz, antennas integrated into wireless devices tend to become less efficient and more difficult to impedance match over small to moderate bandwidths due to the increase in wavelength and the typical small form factor of commercial wireless devices. The antenna accessory resides external to the host device and provides a useful platform for integrating a low frequency antenna; volume internal to the host device is not required for the media antennas and the media antennas are separated further from noise and interfering signals internal to the host device.

In one aspect of the present invention, multiple antennas are integrated into a module with a connector and configured in such a way as to attach external to a cell phone, laptop, or other wireless device. The antenna radiating elements can be passive and can be designed with matching circuits to optimize performance over a specific frequency range. The radiating elements can be co-located with a ferrite material and/or active components coupled to the element to tune across a wide frequency range.

A circuit board can be further integrated within the antenna accessory, and several useful circuits can be used therewith. For example, the circuit board can contain a circuit that has one or more passive or active components for impedance matching and dynamically tuning the antenna. Antenna feed and ground connections can be designed to attach to the connector and make contact with the feed and ground of the host device.

For purposes of this invention, a passive component is defined as any element of an electric circuit that does not require power to operate.

For purposes of this invention, an active element is defined as any element that requires power to operate. These active components can provide an additional inductance or capacitance directly in series or shunt with an elongated portion of the antenna element, so as to modify the standing wave pattern existing along the elongated portion, or to change the effective electrical length of the elongated portion of the antenna element. The active component provides a reactance that cancels the reactance of the antenna, allowing for optimal radiation. Examples of active elements include: a varactor diode, tunable capacitor, or switched capacitor network.

For purposes of this invention, a tuning circuit includes one or more passive or active components connected to the antenna for providing matched impedance.

One or multiple antenna elements are integrated into the media antenna accessory. The antenna element can be one of: a coil, monopole, dipole, inverted F antenna, microstrip antenna, single resonance Isolated Magnetic Dipole (IMD) antenna, dual resonance IMD antenna, planar IMD antenna, or a wire.

The antenna element can be configured on the external portion of the cover of the module housing. Alternately the antenna element can be configured on the internal portion of the module body.

One substantial benefit of an antenna accessory is that it eliminates the requirement for internal volume dedicated to media antennas in the host device. Another benefit of an antenna accessory is the ease of connection to the radios internal to the host device through the external connector supplied on the host device and the connector integrated into the antenna accessory.

The antenna radiating element can be attached to the cover of the module and can comprise multiple layers, such that a multi-layer antenna assembly can be integrated into the module. For example, the antenna element can be configured on the outer layer, feed lines and distributed matching elements such as transmission line element can be configured on inner layers. The multiple conductive layers used to form the antenna element and feed lines can be separated by non-conductive layers. The non-conductive layers can be fabricated by a polymer, fiber, paper, ferrite material, or any combination thereof.

In another embodiment of the invention, switches or other active components are coupled to the antenna element to provide additional optimization in frequency response. For example, a tuned loop coupled to the antenna with active components is adjusted to provide optimization of the impedance match of the antenna along with optimization of the radiating structure.

Figure 1B:
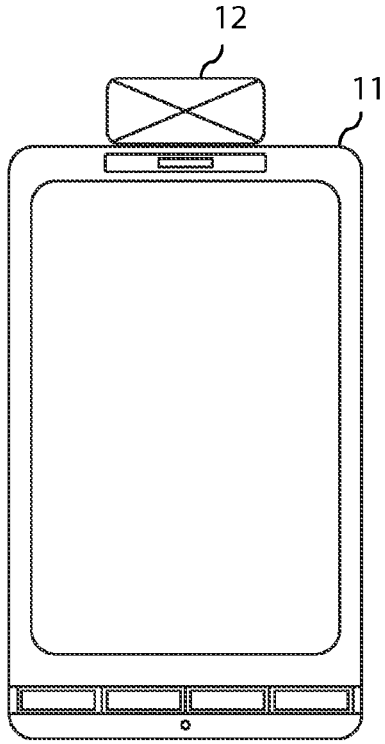

Now turning to the drawings, FIG. 1 illustrates a mobile wireless device 11 with an external antenna module 12 attached thereto. Another configuration is shown where an external antenna module 12 is attached to a mobile wireless device 1 along the top of the device. The antenna accessory module can be connected at the headphones port of the wireless device.

Figure 2A:
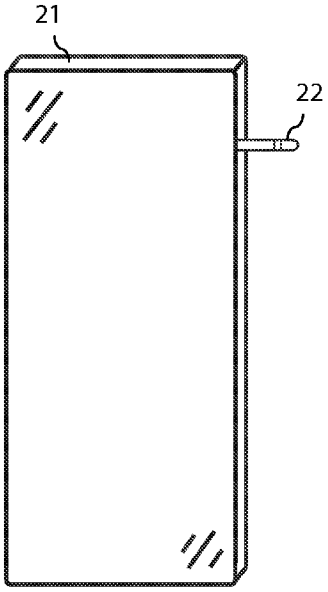
FIGS. 2(*a-b*) illustrate an example of an antenna configuration for an antenna accessory according to various embodiments of the invention.
Figure 2B:
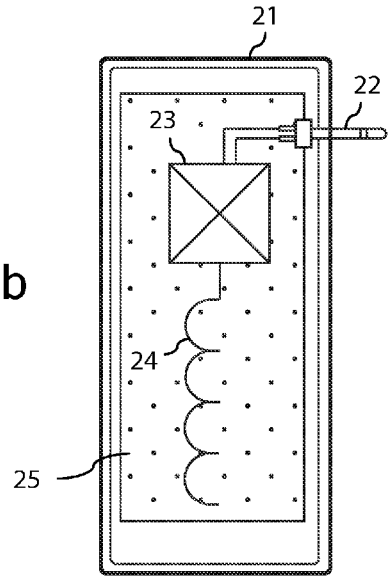

FIG. 2 illustrates an external antenna module. The antenna configuration of the module includes a tuning circuit 23 attached to a circuit board 25. An antenna element 24 is attached to the tuning circuit. A connector 22 is attached to the circuit board and is connected to the tuning circuit. A plastic cover 21 is used to cover and protect the antenna assembly. The plastic cover 21 is shown with a connector 22 protruding from the cover.

Figure 3A:
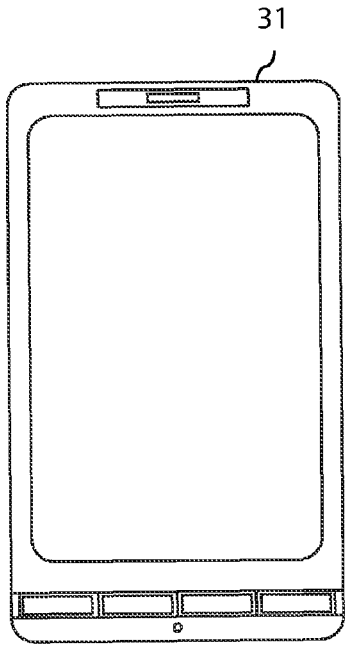
FIGS. 3(*a-c*) illustrate an example of an antenna embedded into a protective cover for a mobile wireless device. A connector element is attached to the protective cover and is used to connect the antenna to the mobile device.
Figure 3B:
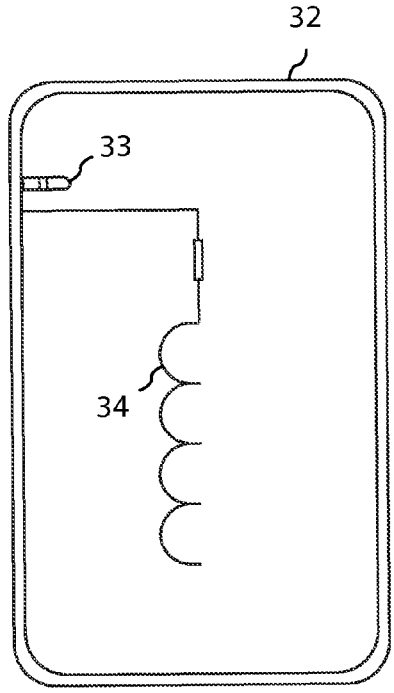
Figure 3C:
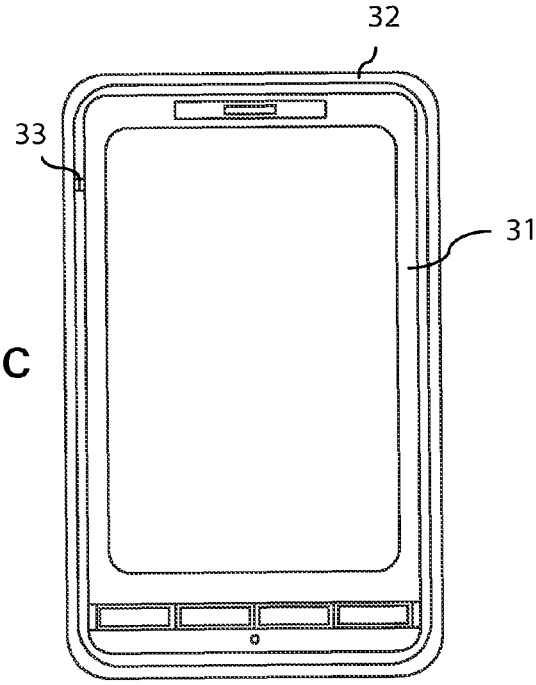

FIG. 3 illustrates a mobile wireless device 31 and a protective cover 32 designed to fit over the mobile device. An antenna element 34 is embedded in the protective cover and a connector 33 is attached to the protective cover and is used to connect the antenna element to the mobile wireless device. The mobile wireless device and protective cover combination is shown.

Figure 4A:
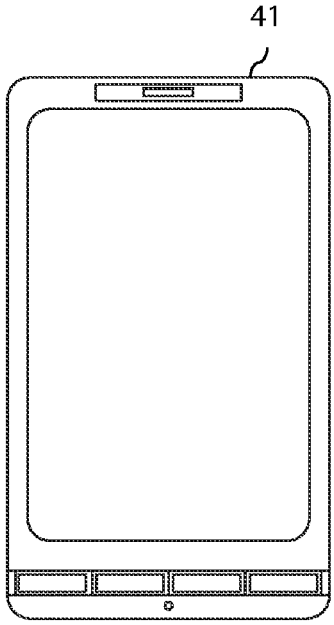
FIGS. 4(*a-c*) illustrate an example of an antenna embedded into a protective cover for mobile wireless devices, the device cover further incorporates a matching circuit for tuning the antenna radiating element along with a connector.
Figure 4B:
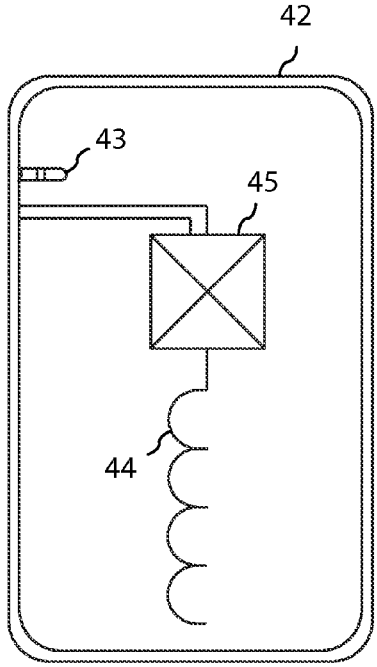
Figure 4C:
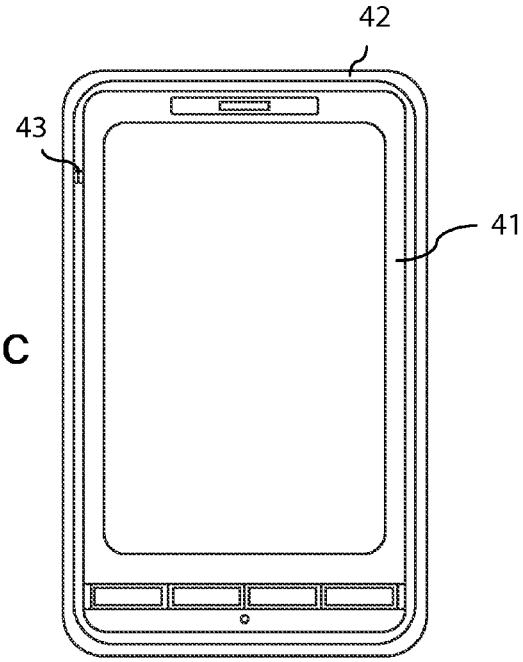

FIG. 4 illustrates a mobile wireless device 41 and a protective cover 42 designed to fit over the mobile device. An antenna element 44 is embedded in the protective cover and a matching circuit 45 is embedded or attached to the protective cover. A connector 43 is attached to the protective cover and is used to connect the antenna element to the mobile wireless device. The mobile wireless device and protective cover combination is shown.

Figure 5:
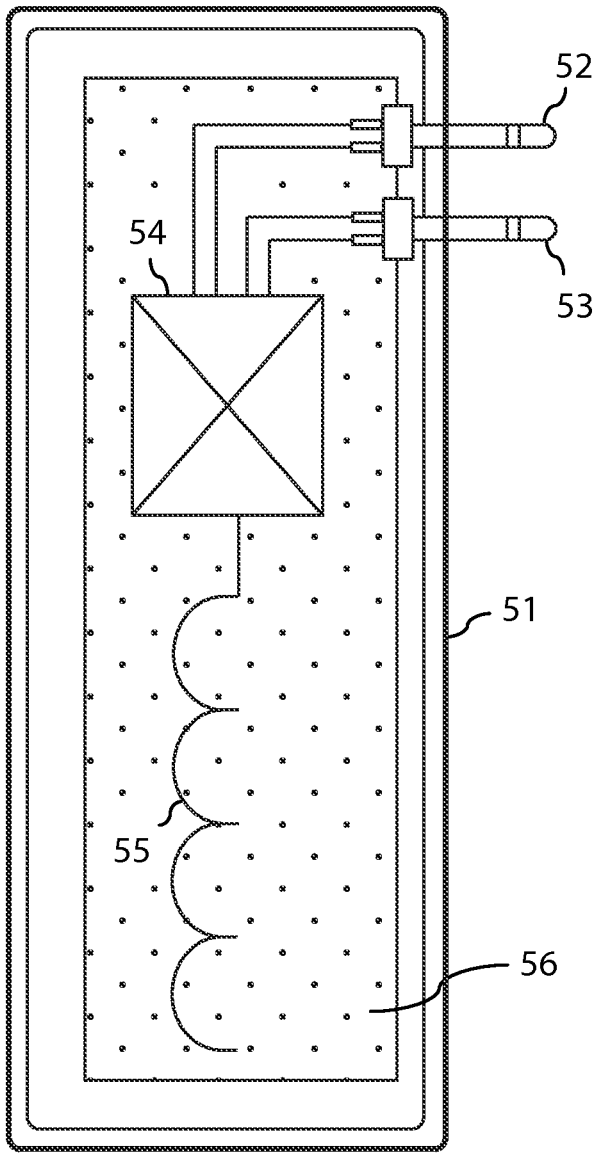
FIG. 5 is an example of an antenna configuration for an antenna accessory wherein a second connector is included to provide a tuning signal and/or a supply signal to an active tuning circuit, the active tuning circuit being further connected to the radiating element.

FIG. 5 illustrates an active antenna configuration where a first connector 52 and a second connector 53 are attached to the circuit board 56 of the external antenna module. An antenna element 55 is attached to the tuning circuit 54. A plastic cover 51 is used to cover and protect the antenna assembly.

The present invention is defined by the claims appended hereto, with the forgoing description being merely illustrative of a preferred embodiment of the invention. Those of ordinary skill in the art may envisage certain modifications to foe forgoing embodiments which, although not explicitly discussed herein, do not depart from the scope of the invention, as defined by the appended claims.

We claim:

1. A media antenna accessory adapted for removable engagement with a wireless communications device, the antenna accessory comprising:

at least one connector element adapted to engage a communications circuit within said wireless communications device;

an antenna radiating element adapted for operation within a DVB-H frequency band, said radiating element being configured for electrical connection with said wireless communications device at said connector element; and a body portion containing said antenna radiating element, said body portion is configured to extend about a peripheral surface of the wireless communications device to form a device case.

2. The antenna accessory of claim 1, further comprising a circuit board and one or more circuits disposed therewith.

3. The antenna accessory of claim 2, wherein said circuit board comprises a tuning circuit, said tuning circuit further comprising one or more active and passive components for impedance matching and dynamically tuning said radiating element.

4. The antenna accessory of claim 1, further comprising one or more parasitic elements, each of said parasitic elements being disposed adjacent to said radiating element for varying one or more radiation pattern characteristics of said radiating element.

5. The antenna accessory of claim 1, further comprising a first radiating element and a second radiating element.

6. The antenna accessory of claim 1, wherein said DVB-H frequency band includes one or more of: FM (87.5 MHz-108 MHz), VHF-III (170 MHz-230 MHz), and UHF-IV/V (470 MHz-862 MHz).

7. The antenna accessory of claim 1, comprising a first connector element and a second connector element, said first and second connector elements each adapted to removably engage a communications circuit within said wireless device.

8. The antenna accessory of claim 7, said first connector element being electrically connected to antenna feed and ground, and said second connector element being electrically connected to one or more active components of said tuning circuit.

9. An antenna accessory for external attachment with a wireless device, comprising:

one or more radiating elements;

a connector element adapted for connection with an electronic port of a wireless device, said connector element being in communication with at least one of said radiating elements; and a device case adapted to substantially surround two or more surfaces of said wireless device, said two or more surfaces each being selected from: a rear surface, side surface, top surface, bottom surface, and front surface;

wherein said radiating elements and connector element are at least partially disposed within said device case.

10. The antenna accessory of claim 9, further comprising one or more parasitic elements, said parasitic elements being disposed adjacent to at least one of said radiating elements.

* * * * *